US010965034B2

(12) United States Patent
Zhinong et al.

(10) Patent No.: US 10,965,034 B2
(45) Date of Patent: Mar. 30, 2021

(54) MILLIMETER WAVE ANTENNA

(71) Applicant: SONY CORPORATION, Tokyo (JP)

(72) Inventors: Ying Zhinong, Lund (SE); Kun Zhao, Lund (SE)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/490,426

(22) PCT Filed: Apr. 26, 2017

(86) PCT No.: PCT/US2017/029650

§ 371 (c)(1),
(2) Date: Aug. 30, 2019

(87) PCT Pub. No.: WO2018/199944

PCT Pub. Date: Nov. 1, 2018

(65) Prior Publication Data

US 2020/0052406 A1 Feb. 13, 2020

(51) Int. Cl.

| | |
|---|---|
| ***H01Q 5/50*** | (2015.01) |
| ***H01Q 9/28*** | (2006.01) |
| ***H01Q 1/24*** | (2006.01) |
| ***H01Q 1/48*** | (2006.01) |

(52) U.S. Cl.

CPC ..... *H01Q 9/285* (2013.01); *H01Q 1/243* (2013.01); *H01Q 1/48* (2013.01); *H01Q 5/50* (2015.01)

(58) Field of Classification Search

CPC ..... H01Q 9/0407; H01Q 9/065; H01Q 9/285; H01Q 5/50

See application file for complete search history.

(56) References Cited

U.S. PATENT DOCUMENTS

| | | | | |
|---|---|---|---|---|
| 5,532,708 | A * | 7/1996 | Krenz | H01Q 9/285 343/795 |
| 7,023,909 | B1 * | 4/2006 | Adams | H01Q 19/24 375/222 |
| 8,022,887 | B1 * | 9/2011 | Zarnaghi | H01Q 3/26 343/846 |
| 8,174,336 | B2 | 5/2012 | Kim | |
| 9,531,077 | B1 | 12/2016 | Weller | |

(Continued)

FOREIGN PATENT DOCUMENTS

| | | |
|---|---|---|
| JP | 2003110329 A | 4/2003 |
| WO | 2015/105605 A1 | 7/2015 |

OTHER PUBLICATIONS

International Search Report and Written Opinion from corresponding International Patent Application No. PCT/US2017/029650, dated Jan. 26, 2018, 12 pages.

(Continued)

*Primary Examiner* — Jason Crawford
(74) *Attorney, Agent, or Firm* — Tucker Ellis LLP

(57) ABSTRACT

A balanced planar antenna having at least one mmWave resonant frequency includes a ground plane, first and second antenna elements, an arm that connects the second antenna element to the ground plane, a feed line connected to the first antenna element and for feeding a radio frequency signal to the first antenna element, and a balun that connects the first antenna element to the ground plane. The ground plane, first antenna element, second antenna element, arm, feed line and balun each are disposed on a substrate and are coplanar.

16 Claims, 8 Drawing Sheets

(56) References Cited

U.S. PATENT DOCUMENTS

| | | | | |
|---|---|---|---|---|
| 2008/0272976 | A1* | 11/2008 | Kitamori | H01Q 9/285 343/793 |
| 2009/0295667 | A1* | 12/2009 | Ma | H01Q 19/30 343/795 |
| 2011/0285474 | A1* | 11/2011 | Ali | H01P 5/10 333/33 |
| 2012/0146869 | A1* | 6/2012 | Holland | H01Q 21/061 343/795 |
| 2012/0146872 | A1* | 6/2012 | Chainon | H01Q 19/24 343/818 |
| 2013/0069837 | A1* | 3/2013 | Cozzolino | H01Q 1/521 343/727 |
| 2014/0361946 | A1* | 12/2014 | Ganchrow | H01Q 19/30 343/795 |
| 2016/0056544 | A1* | 2/2016 | Garcia | H01Q 1/38 343/725 |
| 2016/0181699 | A1* | 6/2016 | Chiang | H01Q 9/065 343/794 |
| 2018/0040955 | A1* | 2/2018 | Vouvakis | H01Q 5/42 |
| 2019/0103682 | A1* | 4/2019 | Thai | H01Q 1/38 |
| 2019/0288382 | A1* | 9/2019 | Kamgaing | H01Q 1/2283 |

OTHER PUBLICATIONS

Lee, Hyeonjin, "CPW-fed to CPS Dipole Antenna of Microstrip Tapered Balun with Triangular Loop Director," J Electr Eng Technol vol. 9, No. 4: 1365-1368, 2014.

Akkermans, J.A.G. et al., "Balanced-fed planar antenna for millimeter-wave transceivers," IEEE Transactions on Antennas and Propagation, vol. 57, No. 10, Oct. 2009.

* cited by examiner

MILLIMETER WAVE ANTENNA

TECHNICAL FIELD OF THE INVENTION

The technology of the present disclosure relates generally to antennas for electronic devices and, more particularly, to an antenna that supports millimeter wave frequencies.

BACKGROUND

Communications standards such as 3G and 4G are currently in wide-spread use. It is expected that infrastructure to support 5G communications will soon be deployed. In order to take advantage of 5G, portable electronic devices such as mobile telephones will need to be configured with the appropriate communications components. These components include an antenna that has one or more resonant frequencies in the millimeter (mm) wave range, which extends from 10 GHz to 100 GHz. In many countries, it is thought that available 5G mmWave frequencies are at 28 GHz and 39 GHz. This spectrum is not continuous in frequency. Therefore, if a mobile device were to support operation at more than one mmWave frequency, the antenna would need to support the frequencies of interest. This type of antenna is sometimes referred to as a multimode antenna and could be a multiple band (multiband) antenna.

Also, since the wavelength is very small, performance may be enhanced by using multiple antennas in an array. An array antenna, under the correct phasing, offers potential antenna gain but also adds a challenge. The phasing narrows the antenna radiation into a beam that may be directed toward the base station. The antenna elements of the array should have a broad pattern, good polarization, low coupling and low ground currents. For dual band antennas at the proposed 28 GHz and 39 GHz frequencies, achieving these characteristics is a challenge.

At mmWave frequencies, conventional antennas may induce a strong surface wave in the chassis (housing) of the mobile device that distorts the radiation pattern emitted by the antenna element. This distortion can lead to poor operational performance and may prevent antenna array applications. This phenomenon occurs since the electrical size of the chassis in terms of wavelength is much larger than the wavelength of the emitted signal.

FIG. 1 illustrates a portion of a conventional mmWave antenna 10 that is subject to this phenomenon. The antenna 10 is a planar antenna that includes a ground plane 12 disposed on a substrate 14, such as a printed circuit board (PCB). The antenna includes a single antenna element 16 disposed on the substrate 14 adjacent an edge of the ground plane 12. The antenna element 16 is fed by a feed line 18 that is also disposed on the substrate 18. The feed line 18 and the antenna element 16 may be microstrip lines. A portion of the feed line 18 is located in a notch 20 formed in the ground plane 12 as illustrated. The feed line 18 connects to a component that supplies an RF signal at connection point 22 that is schematically represented by a triangular shaped item in FIG. 1. The component that supplies the RF signal may be an output of a power amplifier or an output of a tuning or impedance matching circuit. The component that supplies the RF signal may be located on another layer of the substrate 14 or on a separate substrate.

For a sense of scale of the ground plane 12 relative to the antenna element 16, FIG. 2 shows the entire ground plane 12, feed line 18 and antenna element 16. FIG. 2 also illustrates the surface currents induced during operation at 28 GHz. The surface currents propagate along the edge of the ground plane 12 at which the antenna element 16 is present. FIG. 3 shows a corresponding radiation pattern, which exhibits relatively strong side lobes that are not desirable in array applications.

SUMMARY

This disclosure describes a balanced planar antenna with a balun structure to support one or more 5G mmWave operating frequencies. A parasitic element may be added for dual band operation. The elements may be formed in one metal layer on a PCB and may be arranged to cover, for example, a 28 GHz band and multi-resonance 35-42 GHz bands. Emission patterns may have broad coverage angles and good balance.

According to aspects of the disclosure, a planar antenna has at least one mmWave resonant frequency and includes a ground plane disposed on a substrate; a first antenna element disposed on the substrate; a second antenna element disposed on the substrate; an arm disposed on the substrate, the arm connecting the second antenna element to the ground plane; a feed line disposed on the substrate and connected to the first antenna element, the feed line for feeding a radio frequency signal to the first antenna element; and a balun disposed on the substrate and connecting the first antenna element to the ground plane, and the balun electrically balancing the antenna; and wherein the ground plane, first antenna element, second antenna element, arm, feed line and balun are coplanar.

According to one embodiment of the antenna, the feed line is an unbalanced coplanar waveguide.

According to one embodiment of the antenna, a portion of the feed line is disposed in a notch formed in the ground plane.

According to one embodiment of the antenna, an edge of the balun adjacent the feed line is co-linear with a corresponding first edge of the notch.

According to one embodiment of the antenna, an edge of the arm adjacent the feed line is co-linear with a corresponding second edge of the notch.

According to one embodiment of the antenna, longitudinal axes of the antenna elements are co-linear.

According to one embodiment of the antenna, a first end of the first antenna element is connected to the feed line.

According to one embodiment of the antenna, the balun is connected to the first antenna element between the feed line and a free distal end of the first antenna element.

According to one embodiment of the antenna, a first end of the second antenna element is connected to the arm.

According to one embodiment of the antenna, the first end of the first antenna element is adjacent the first end of the second antenna element.

According to one embodiment of the antenna, the antenna further includes a parasitic element disposed on the substrate adjacent and parallel the first and second antenna elements, the parasitic element adding a second resonant frequency within the millimeter wave frequency range to the antenna.

According to one embodiment of the antenna, the parasitic element increases a bandwidth of the at least one mmWave resonant frequency.

According to one embodiment of the antenna, the at least one mmWave resonant frequency is at about 28 GHz and the second resonant frequency is at about 39 GHz.

According to one embodiment of the antenna, the arm is linear and no other elements interconnect the second antenna element to the ground plane.

According to one embodiment of the antenna, the balun is linear and no other elements interconnect the first antenna element to the ground plane.

According to one aspect of the disclosure, an electronic device includes the balanced planar antenna; and communication circuitry operatively coupled to the antenna, wherein the communication circuitry is configured to generate the radio frequency signal that is feed to the antenna for emission as part of wireless communication with another device.

The disclosed antenna, which is balanced and planar in structural arrangement, is easy to manufacture, consumes low volume in mobile devices, may be implemented in an array, and induces low surface currents in the chassis of the mobile device. As a result, the radiation pattern emitted by the antenna has desirable characteristics and can support mmWave operation.

DETAILED DESCRIPTION OF EMBODIMENTS

Figure 1:
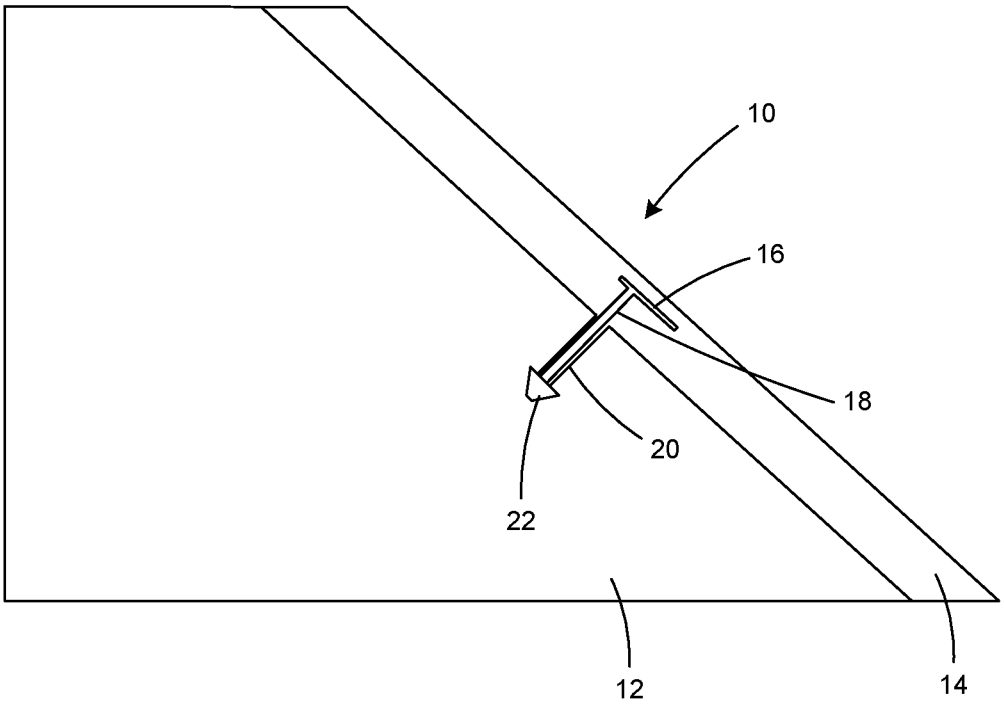
FIG. 1 Prior Art
FIG. 1 is a representation of an antenna arrangement according to the prior art.
Figure 2:
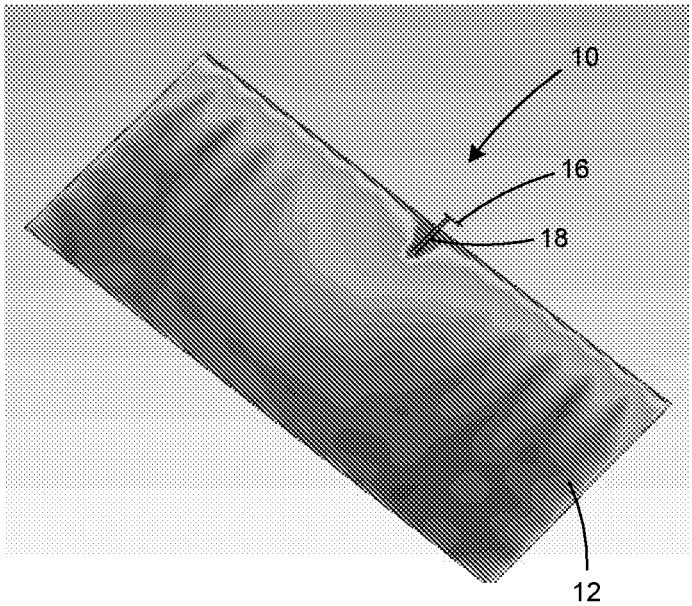
FIG. 2 Prior Art
FIG. 2 is another representation of the antenna arrangement of FIG. 1 and shows surface currents induced in the antenna.
Figure 3:
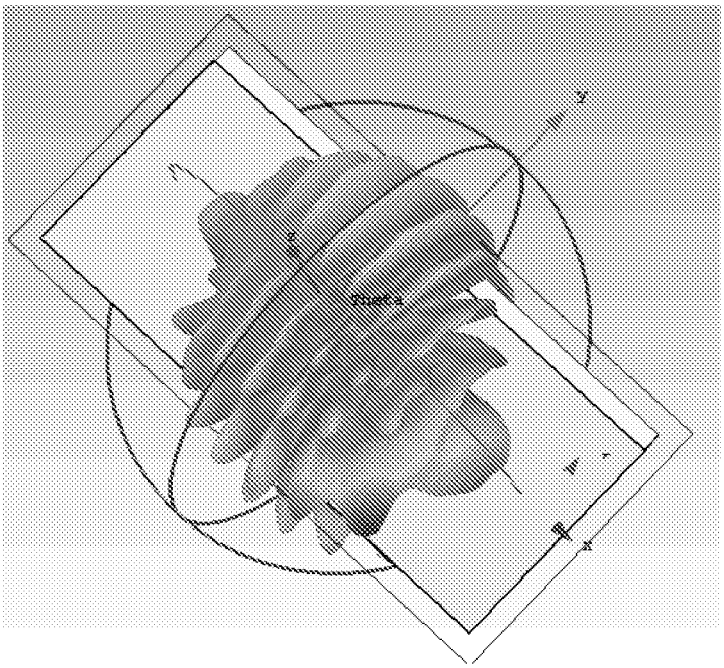
FIG. 3 Prior Art
FIG. 3 is a radiation pattern of the antenna of FIGS. 1-2.

Embodiments will now be described with reference to the drawings, wherein like reference numerals are used to refer to like elements throughout. It will be understood that the figures are not necessarily to scale. Features that are described and/or illustrated with respect to one embodiment may be used in the same way or in a similar way in one or more other embodiments and/or in combination with or instead of the features of the other embodiments.

Described below, in conjunction with the appended figures, are various embodiments of antenna structures that may be used with mobile terminals, such as mobile telephones. Although the figures illustrate one antenna, it will be understood that the mobile terminal may include an array of the antennas for a beam shaping or sweeping application.

Figure 4:
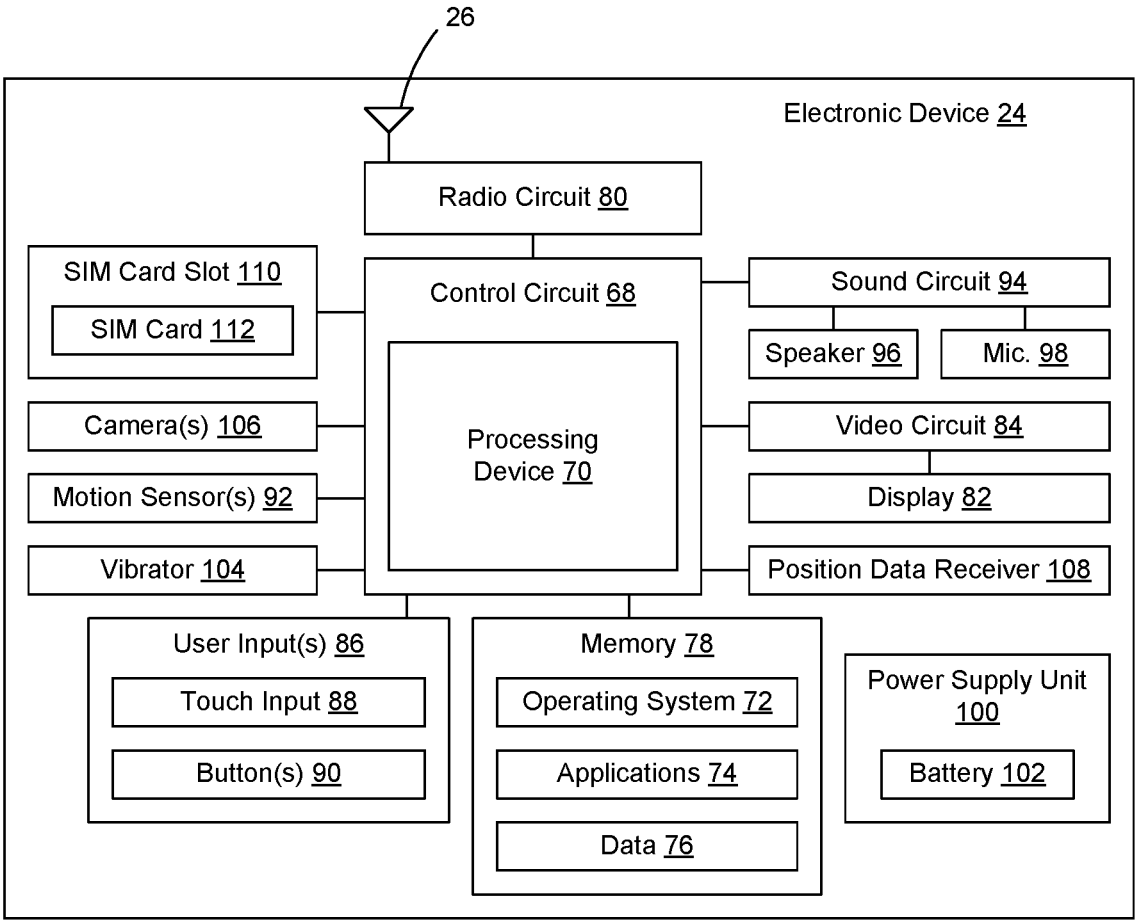
FIG. 4 is a schematic diagram of an electronic device that includes an antenna according to the disclosure.

Referring to FIG. 4, illustrated is an exemplary environment for the disclosed antenna. The exemplary environment is an electronic device 24 configured as a mobile radiotelephone, more commonly referred to as a mobile phone or a smart phone. The electronic device 24 may be referred to as a user equipment or UE. The electronic device 24 may be, but is not limited to, a mobile radiotelephone, a tablet computing device, a computer, a gaming device, an Internet of Things (IoT) device, a media player, etc. Additional details of the exemplary electronic device 24 are described below.

Figure 5:
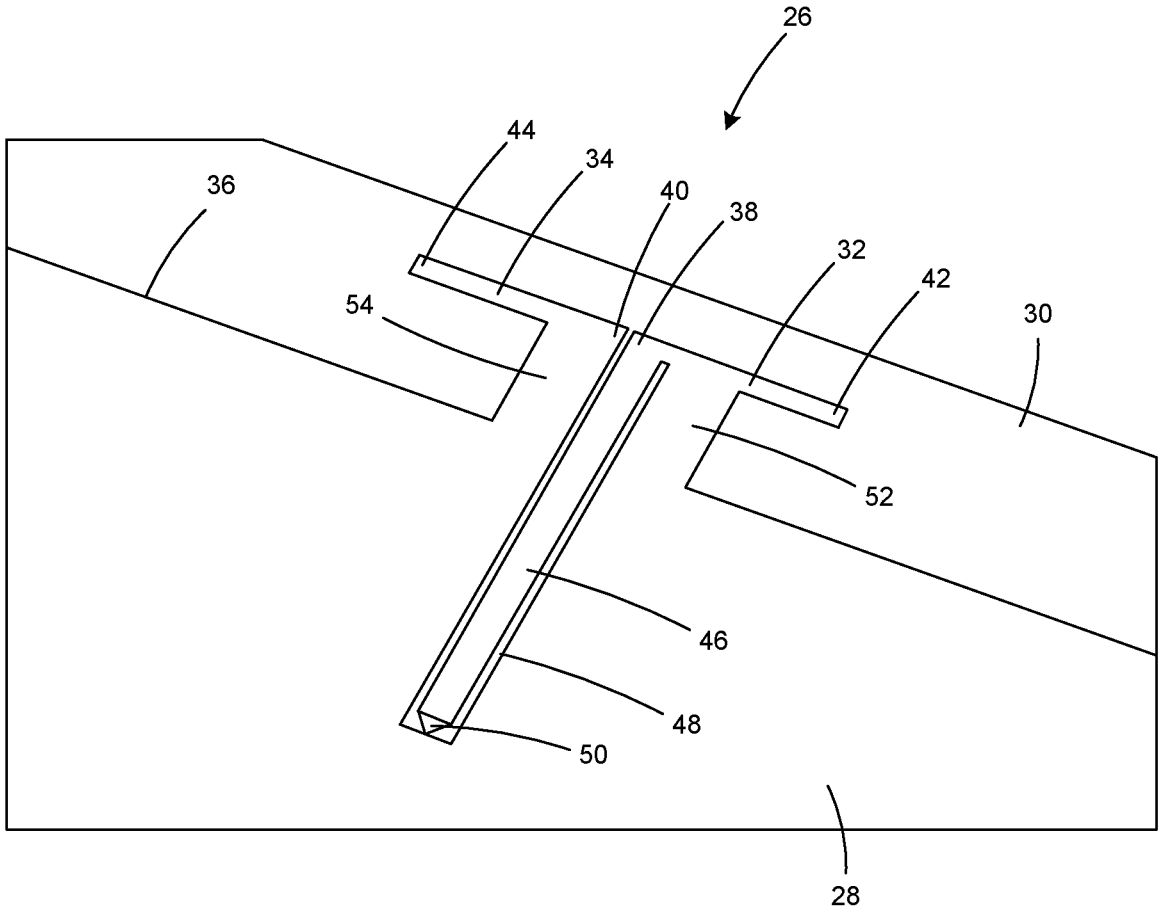
FIG. 5 is a representation of an antenna arrangement according to the disclosure.

As indicated, the electronic device 24 includes an antenna 26 to support wireless communications. With additional reference to FIG. 5, a portion of the antenna 26 is illustrated. The antenna 26 is a planar balanced dipole antenna. In contrast, the antenna of FIG. 1 is an unbalanced antenna.

The antenna 26 includes a ground plane 28 disposed on a substrate 30, such as a printed circuit board (PCB). The antenna includes a first antenna element 32 and a second antenna element 34 disposed on the substrate 30. The total electrical length of the antenna elements 32, 34 in the illustrated embodiment is a half wavelength of the resonance frequency of the antenna 26. The antenna elements 32, 34 may be microstrip lines having longitudinal axes that are co-linear and parallel an adjacent edge 36 of the ground plane 28. In the illustrated embodiment, the antenna elements 32, 34 are spaced apart from the edge 36 of the ground plane 28 by an electrical distance of a quarter wavelength. The physical distance will vary according to the desired resonant frequency.

The first antenna element 32 has a first end 38 (also referred to as a proximal end) adjacent a first end 40 (also referred to as a proximal end) of the second antenna element 34. Opposite the first end 38, the first antenna element 32 has a free second end 42 (also referred to as a distal end). Similarly, the second antenna element 34 has a free second end 44 (also referred to as a distal end) opposite the first end 40.

The first end 38 of the first antenna element 32 is connected to and fed by a feed line 46 that is also disposed on the substrate 30. The feed line 46 may be a microstrip line and may be an unbalanced coplanar waveguide (CPW). As will be understood, the CPW is formed since it is a conductor that is separated from a pair of pseudo ground planes. The feed line 46 may be one wavelength long. A portion of the feed line 46 (e.g., a portion that is about three quarters of a wavelength long) is located in a notch 48 formed in the ground plane 28. The feed line 46 connects to a component that supplies an RF signal at connection point 50. The connection point 50 is schematically represented by a triangular shaped item in FIG. 4. The component that supplies the RF signal may be an output of a power amplifier or an output of a tuning or impedance matching circuit. The component that supplies the RF signal may be located on another layer of the substrate 30 or on a separate substrate.

A balun 52 interconnects the ground plane 28 and the first antenna element 32. The balun 52 may be considered a wide-band balun due to its geometry and position relative to the first antenna element 32. In an exemplary embodiment, the balun may be 1.3 mm by 0.75 for antenna operation at a center frequency of about 30 GHz. Additionally, at the same center frequency, the balun may be spaced apart from the feed line 46 by 0.15 mm to obtain a high degree of impedance matching. The balun 52 is disposed on the substrate 30. The balun 52 connects to the first antenna element between the first end 38 and the second end 42, preferably adjacent the feed line 46.

A balun converts an unbalanced signal (e.g., a signal working against ground) from the feed line 46 to a balanced signal (e.g., two signals working against each other where ground is irrelevant) in the poles of the antenna 26. Thus, the balun 52 may be considered as being configured to transfer the unbalanced CPW to a balanced dipole antenna. The Balun causes the currents in the feed-line 46 conductor to be equal in magnitude and opposite in phase in the antenna elements 32, 34, resulting in a zero imbalance current. The balun 52 in the illustrated embodiment is a quarter wavelength long, but may be odd multiples of a quarter wavelength.

A conductor (also referred to herein as an arm 54) interconnects the ground plane 28 and the second antenna element 34. The arm 54 connects to the first end 40 of the second antenna element 34. The arm 54 serves as a conductive pathway between the second antenna element 34 and the ground plane 28. But the arm 54 need not serve as a balun 52 since the second antenna element 34 is not directly feed by the feedline 46 and is, instead, feed through the first antenna element 34.

In one embodiment, an edge of the balun 52 closest the first end 38 of the first antenna element 32 is co-linear with the corresponding edge of the slot 48 in which the feed line 46 is located. Similarly, an edge of the arm 54 closest the first end 40 of the second antenna element 34 is co-linear with the corresponding edge of the slot 48 in which the feed line 46 is located. Other arrangement may be possible, but the spacing of the feedline 46 to the balun 52 can affect impedance matching.

The configuration of the antenna 26 results in the second antenna element 34 connected to the ground plane 28 by way of the arm 54 and the first antenna element 32 connected to the ground plane 28 by way of the balun 52. As a result, there is typically no potential difference between the antenna elements 32, 34 and the ground plane 28 and no currents are induced on the ground plane 28.

The ground plane 28, the antenna elements 32, 34, the feed line 46, the balun 52 and the arm 54 may be made from a coplanar, monolithic layer of conductive material (e.g., copper, other conductive metal, or other conductive material) disposed on the substrate 30. In another embodiment, the various antenna 26 parts may be made from separate, but interconnected, metal elements that are disposed in coplanar arrangement on the substrate 30.

Although only one antenna 26 is illustrated, it will be understood that plural similarly configured antennas 26 may be present to form an antenna array. The antennas of the array may be coplanar with each other and/or connect with the same ground plane 28 or respective ground planes.

Figure 6:
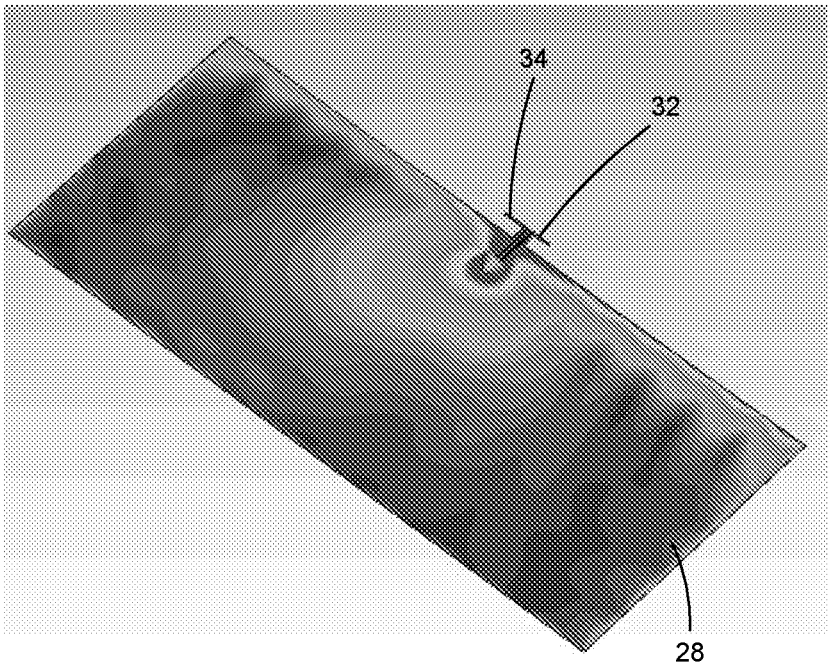
FIG. 6 is another representation of the antenna arrangement of FIG. 5 and shows surface currents induced in the antenna.
Figure 7:
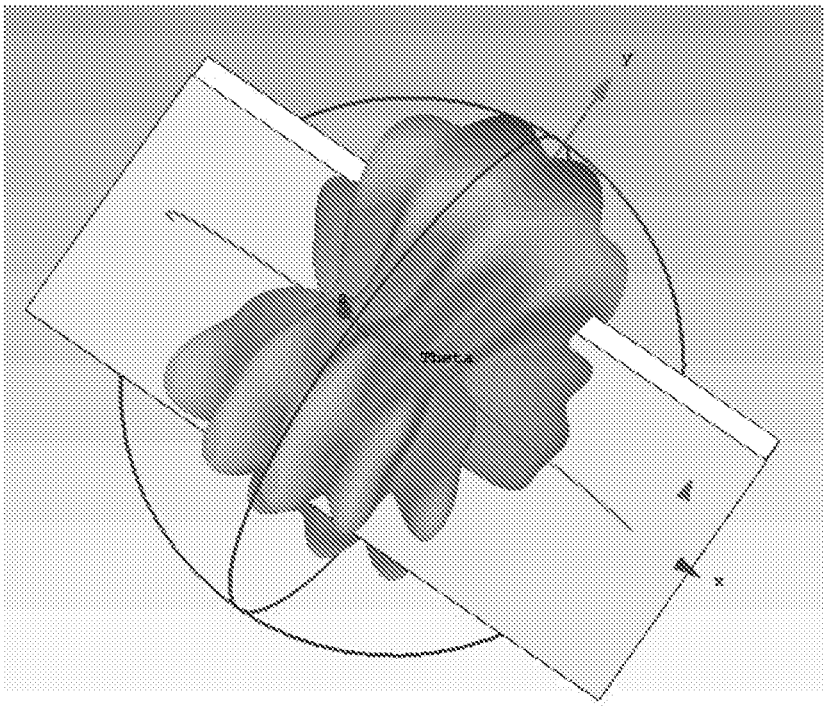
FIG. 7 is a radiation pattern of the antenna of FIGS. 5-6.
Figure 8:
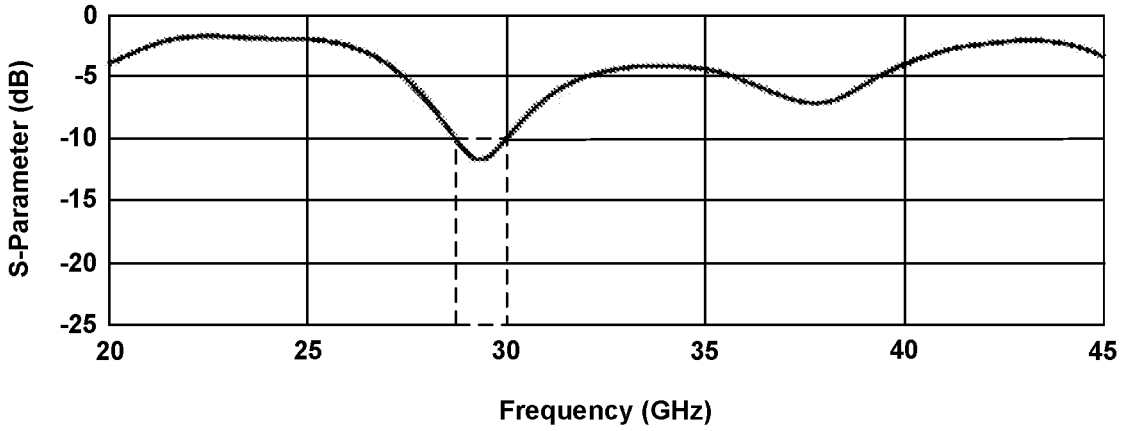
FIG. 8 is a plot of operating characteristics of the antenna of FIGS. 5-6.

For a sense of scale of the ground plane 28 relative to the antenna elements 32, 34, FIG. 6 shows the entire ground plane 28, antenna elements 32, 34, feed line 46 (not numbered in FIG. 6), balun 52 (not numbered in FIG. 6) and arm 54 (not numbered in FIG. 6). FIG. 6 also illustrates the surface currents induced during operation at 28 GHz. FIG. 7 shows a corresponding radiation pattern. FIG. 8 is a plot of S(1,1)-parameters over frequency for the antenna 26. A resonant frequency appears around 28 GHz as highlighted by broken line box.

Figure 9:
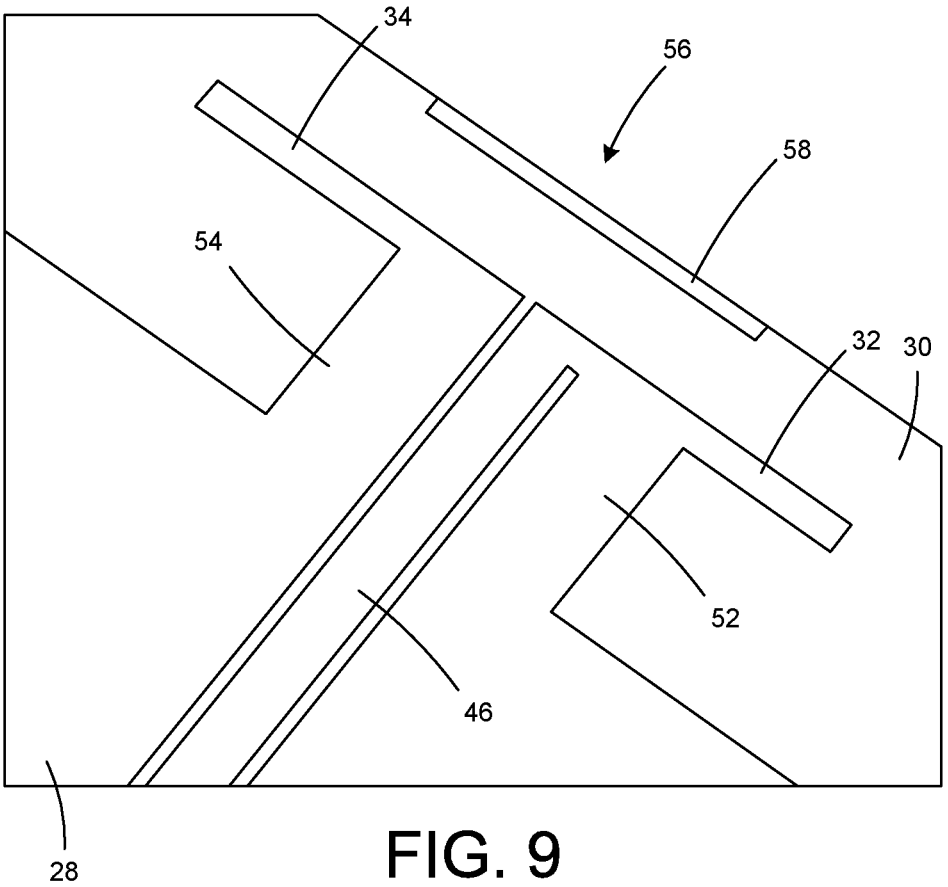
FIG. 9 is a representation of another antenna arrangement according to the disclosure.

With additional reference to FIG. 9, another embodiment of the antenna is illustrated. In this embodiment, the antenna (now referred to by reference numeral 56) has the same structural arrangement as the antenna 26 of FIG. 5 but a parasitic element 58 is added. As will be understood, the parasitic element 58 is an element that is not driven with an RF signal. In one embodiment, the parasitic element 58 is not electrically connected to any other elements of the antenna 26, but functions as a passive resonator to establish the second resonant mode. The parasitic element 58 is added to introduce an additional resonant frequency, thus making the antenna 56 a multiband antenna. In the illustrated embodiment, the parasitic element 58 is a microstrip line disposed on the substrate 30. The parasitic element 58 is coplanar with the other antenna 56 components, including the ground plane 28, antenna elements 32, 34, feed line 46, balun 52 and arm 54. A longitudinal axis of the parasitic element 58 is parallel to the longitudinal axes of the antenna elements 32, 34. In one embodiment, the parasitic element 58 is spaced apart from the antenna elements 32, 34 by a quarter wavelength, although adjustment to the electrical distance may be made to optimize impedance matching. The parasitic element 58 of the illustrated embodiment is a half wavelength in length, and may be centered relative to the gap between the first and second antenna elements 32, 34.

The resonant frequencies may be controlled by adjusting one or both of the length of the parasitic element 58 or the distance of the parasitic element 58 from the antenna elements 32, 34. To increase the number of resonant frequencies to support additional operating bands, additional parasitic elements may be added on the substrate 30 parallel to the parasitic element 58 and radially outward from the parasitic element 58 relative to the ground plane 28.

Figure 10:
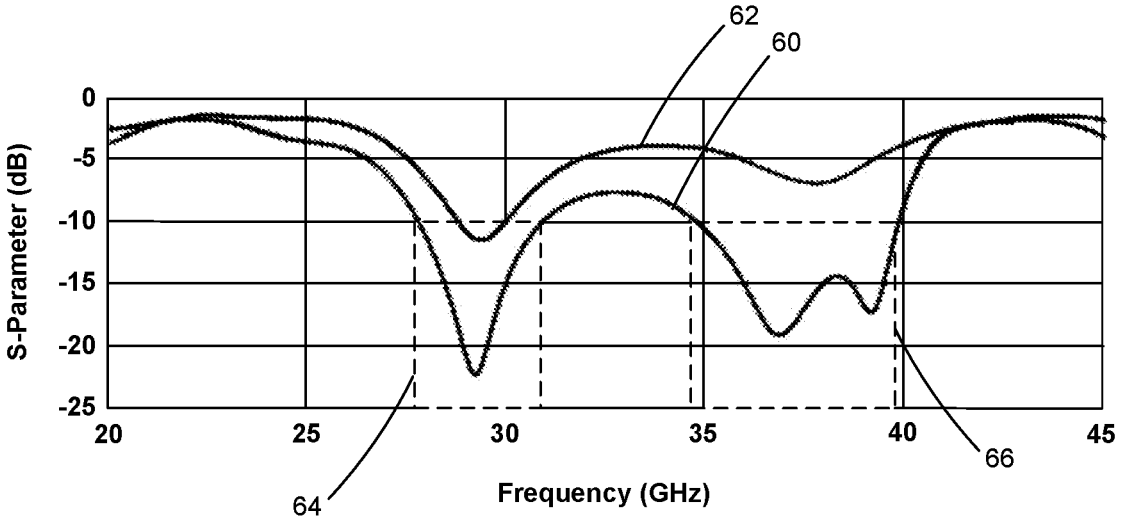
FIG. 10 is a plot of operating characteristics of the antenna of FIG. 9.

At curve 60, FIG. 10 shows a plot of S(1,1)-parameters over frequency for the antenna 56. For comparison, FIG. 10 also shows the plot of S(1,1)-parameters over frequency for the antenna 26 at curve 62. Similar to the antenna 26, a resonant frequency appears around 28 GHz for antenna 56 as highlighted by broken line box 64. A high resonant mode is also established as highlighted by broken line box 66. The high resonant mode has peaks around 36 GHz and around 39 GHz. Compared to the performance for antenna 26 (as represented by curve 62), the bandwidth of antenna 56 at 28 GHz widens (e.g., as indicated by parts of curves 60 and 62 inside broken line box 64) and multiband resonance is realized. Other frequencies are supportable by scaling the dimensions of the to components of the antenna 26.

Figure 11:
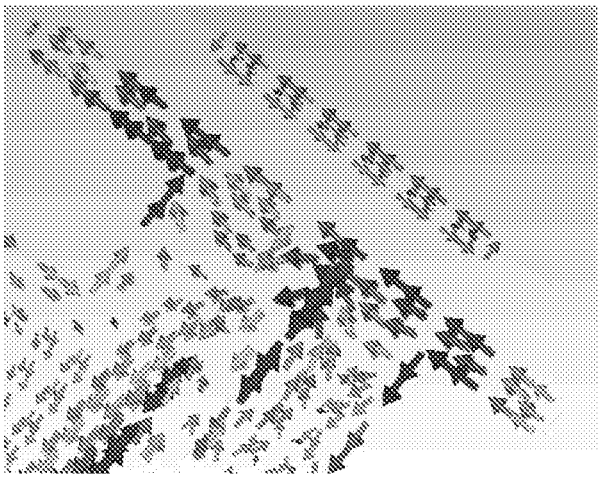
FIGS. 11-12 are representations of surface currents of the antenna of FIG. 9 at respective resonant frequencies.
Figure 12:
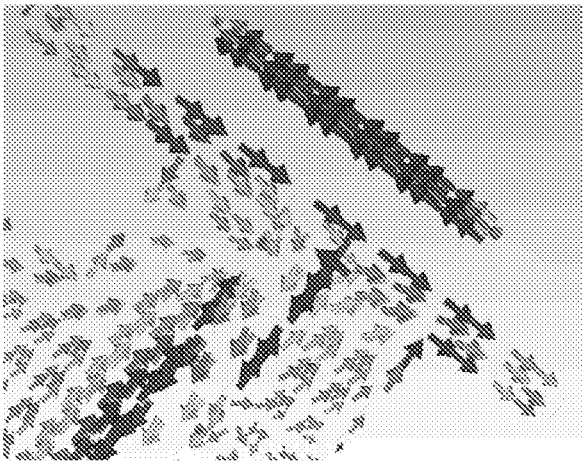
Figure 13:
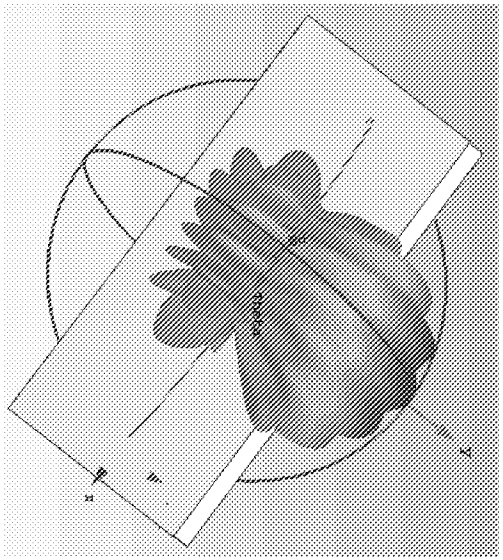
FIGS. 13-15 are radiation patterns of the antenna of FIG. 9 at respective resonant frequencies.
Figure 14:
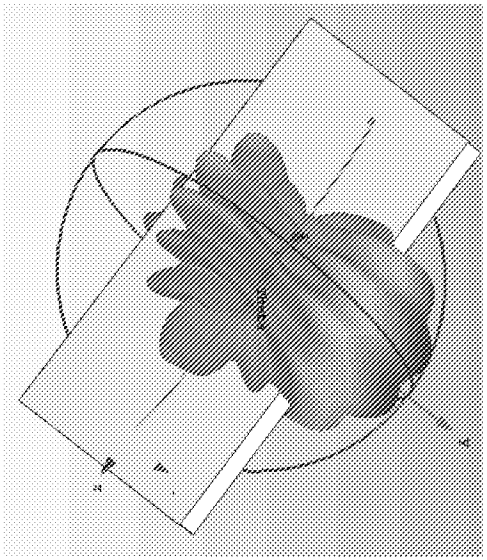
Figure 15:
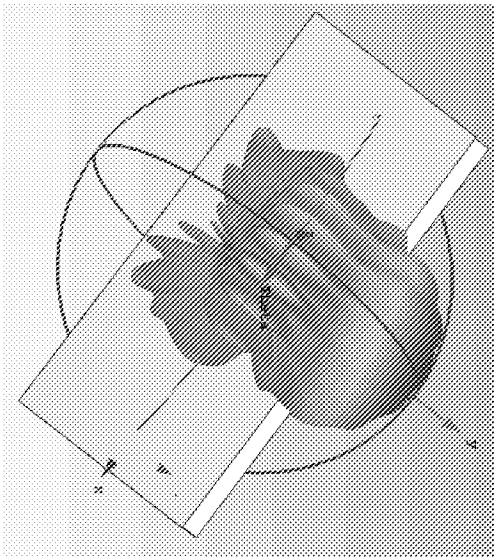

FIG. 11 illustrates surface currents of the antenna 56 at 28 GHZ and FIG. 12 illustrates surface currents of the antenna 56 at 39 GHz. In FIGS. 11-12, the current distributions depict how the antenna 26 operates in multiple frequencies. FIG. 13 shows a corresponding radiation pattern at 28 GHz. FIG. 14 shows a corresponding radiation pattern at 36 GHz. FIG. 15 shows a corresponding radiation pattern at 39 GHz. It may be noted from FIGS. 13-15 that the radiation pattern of the antenna 26 does not have strong side lobes since surface waves are suppressed by the Balun. This is a desirable characteristic for array implementations.

As will be appreciated, the foregoing disclosure describes a multiband balanced antenna structure that is configurable to support 5G communications in mmWave bands with desirable radiation patterns. The balanced antenna mode is realized using a wideband balun that supports multiband resonance modes. Also, the antenna structure is embodied in a planar structure that is relatively easy to manufacture and does not consume excessive space in mobile electronic devices where space constraints are typically an issue.

Returning to FIG. 4, illustrated is a schematic block diagram of the electronic device 24 in an exemplary embodiment as a mobile telephone that uses the antenna 26 for radio (wireless) communications. In one embodiment, the antenna 26 supports communications with a base station of a cellular telephone network, but may be used to support other wireless communications such as, but not limited to, WiFi communications. Additional antennas may be present to support other types of communications such as, but not limited to, WiFi communications, Bluetooth communications, body area network (BAN) communications, near field communications (NFC), and 3G and/or 4G communications.

The electronic device 24 includes a control circuit 68 that is responsible for overall operation of the electronic device 24. The control circuit 68 includes a processor 70 that executes an operating system 72 and various applications 74. The operating system 72, the applications 74, and stored data 76 (e.g., data associated with the operating system 72, the applications 74, and user files), are stored on a memory 78. The operating system 72 and applications 74 are embodied in the form of executable logic routines (e.g., lines of code, software programs, etc.) that are stored on a non-transitory computer readable medium (e.g., the memory 78) of the electronic device 24 and are executed by the control circuit 68.

The processor 70 of the control circuit 68 may be a central processing unit (CPU), microcontroller, or microprocessor. The processor 70 executes code stored in a memory (not shown) within the control circuit 68 and/or in a separate memory, such as the memory 78, in order to carry out operation of the electronic device 24. The memory 78 may be, for example, one or more of a buffer, a flash memory, a hard drive, a removable media, a volatile memory, a non-volatile memory, a random access memory (RAM), or other suitable device. In a typical arrangement, the memory 78 includes a non-volatile memory for long term data storage and a volatile memory that functions as system memory for the control circuit 68. The memory 78 may exchange data with the control circuit 68 over a data bus. Accompanying control lines and an address bus between the memory 78 and the control circuit 68 also may be present. The memory 78 is considered a non-transitory computer readable medium.

As indicated, the electronic device 24 includes communications circuitry that enables the electronic device 24 to establish various wireless communication connections. In the exemplary embodiment, the communications circuitry includes a radio circuit 80. The radio circuit 80 includes one or more radio frequency transceivers and is operatively connected to the antenna 26 and any other antennas of the electronic device 24. In the case that the electronic device 24 is a multi-mode device capable of communicating using more than one standard or protocol, over more than one radio access technology (RAT) and/or over more than one radio frequency band, the radio circuit 80 represents one or more than one radio transceiver, tuners, impedance matching circuits, and any other components needed for the various supported frequency bands and radio access technologies. Exemplary network access technologies supported by the radio circuit 80 include cellular circuit-switched network technologies and packet-switched network technologies. The radio circuit 80 further represents any radio transceivers and antennas used for local wireless communications directly with another electronic device, such as over a Bluetooth interface and/or over a body area network (BAN) interface.

The electronic device 24 further includes a display 82 for displaying information to a user. The display 82 may be coupled to the control circuit 68 by a video circuit 84 that converts video data to a video signal used to drive the display 82. The video circuit 84 may include any appropriate buffers, decoders, video data processors, and so forth.

The electronic device 24 may include one or more user inputs 86 for receiving user input for controlling operation of the electronic device 24. Exemplary user inputs 86 include, but are not limited to, a touch sensitive input 88 that overlays or is part of the display 82 for touch screen functionality, and one or more buttons 90. Other types of data inputs may be present, such as one or more motion sensors 92 (e.g., gyro sensor(s), accelerometer(s), etc.).

The electronic device 24 may further include a sound circuit 94 for processing audio signals. Coupled to the sound circuit 94 are a speaker 96 and a microphone 98 that enable audio operations that are carried out with the electronic device 24 (e.g., conduct telephone calls, output sound, capture audio, etc.). The sound circuit 94 may include any appropriate buffers, encoders, decoders, amplifiers, and so forth.

The electronic device 24 may further include a power supply unit 100 that includes a rechargeable battery 102. The power supply unit 100 supplies operational power from the battery 102 to the various components of the electronic device 24 in the absence of a connection from the electronic device 24 to an external power source.

The electronic device 24 also may include various other components. For instance, the electronic device 24 may include one or more input/output (I/O) connectors (not shown) in the form electrical connectors for operatively connecting to another device (e.g., a computer) or an accessory via a cable, or for receiving power from an external power supply.

Another exemplary component is a vibrator 104 that is configured to vibrate the electronic device 24. Another exemplary component may be one or more cameras 106 for taking photographs or video, or for use in video telephony. As another example, a position data receiver 108, such as a global positioning system (GPS) receiver, may be present to assist in determining the location of the electronic device 24. The electronic device 24 also may include a subscriber identity module (SIM) card slot 110 in which a SIM card 112 is received. The slot 110 includes any appropriate connectors and interface hardware to establish an operative connection between the electronic device 24 and the SIM card 112.

Although certain embodiments have been shown and described, it is understood that equivalents and modifications falling within the scope of the appended claims will occur to others who are skilled in the art upon the reading and understanding of this specification.

What is claimed is:

1. A planar antenna having at least one mmWave resonant frequency, comprising:

a ground plane disposed on a substrate;

a first antenna element disposed on the substrate;

a second antenna element disposed on the substrate;

an arm disposed on the substrate, the arm connecting the second antenna element to the ground plane;

a feed line disposed on the substrate and connected to the first antenna element, the feed line for feeding a radio frequency signal to the first antenna element; and a balun disposed on the substrate and connecting the first antenna element to the ground plane independently from the arm, and the balun electrically balancing the antenna; and wherein the ground plane, first antenna element, second antenna element, arm, feed line and balun are coplanar; and wherein the second antenna element and the arm are separate from the feed line, the first antenna element and the balun so that a conductive pathway between the first and second antenna elements is not present other than by way of the ground plane.

2. The antenna of claim 1, wherein the feed line is an unbalanced coplanar waveguide.

3. The antenna of claim 1, wherein a portion of the feed line is disposed in a notch formed in the ground plane.

4. The antenna of claim 3, wherein an edge of the balun adjacent the feed line is co-linear with a corresponding first edge of the notch.

5. The antenna of claim 3, wherein an edge of the arm adjacent the feed line is co-linear with a corresponding second edge of the notch.

6. The antenna of claim 1, wherein longitudinal axes of the antenna elements are co-linear.

7. The antenna of claim 6, wherein a first end of the first antenna element is connected to the feed line.

8. The antenna of claim 7, wherein the balun is connected to the first antenna element between the feed line and a free distal end of the first antenna element.

9. The antenna of claim 6, wherein a first end of the second antenna element is connected to the arm.

10. The antenna of claim 9, wherein the first end of the first antenna element is adjacent the first end of the second antenna element.

11. The antenna of claim 1, further comprising a parasitic element disposed on the substrate adjacent and parallel the first and second antenna elements, the parasitic element adding a second resonant frequency within the millimeter wave frequency range to the antenna.

12. The antenna of claim 11, wherein the parasitic element increases a bandwidth of the at least one mmWave resonant frequency.

13. The antenna of claim 11, wherein the at least one mmWave resonant frequency is at about 28 GHz and the second resonant frequency is at about 39 GHz.

14. The antenna of claim 1, wherein the arm is linear and no other elements interconnect the second antenna element to the ground plane.

15. The antenna of claim 1, wherein the balun is linear and no other elements interconnect the first antenna element to the ground plane.

16. An electronic device, comprising:

the balanced planar antenna of claim 1; and communication circuitry operatively coupled to the antenna, wherein the communication circuitry is configured to generate the radio frequency signal that is feed to the antenna for emission as part of wireless communication with another device.

* * * * *